US005841270A

United States Patent [19]

Do et al.

[11] Patent Number: 5,841,270

[45] Date of Patent: Nov. 24, 1998

[54] VOLTAGE AND/OR CURRENT REFERENCE GENERATOR FOR AN INTEGRATED CIRCUIT

[75] Inventors: Tien-Dung Do, Villa Julia-Impasse des Mésanges; David Naura, Tivoli-bât, both of France

[73] Assignee: SGS-Thomson Microelectronics S.A., Saint Genis, France

[21] Appl. No.: 685,434

[22] Filed: Jul. 23, 1996

[30] Foreign Application Priority Data

Jul. 25, 1995 [FR] France ..... 95 09023

[51] Int. Cl.[6] ..... G05F 3/28; G05F 3/30

[52] U.S. Cl. ..... 323/314; 323/316; 323/907

[58] Field of Search ..... 323/313, 314, 323/315, 316, 907

[56] References Cited

U.S. PATENT DOCUMENTS

| | | | |
|---|---|---|---|
| 4,723,108 | 2/1988 | Murphy et al. | 323/315 |
| 4,970,415 | 11/1990 | Fitzpatrick et al. | 307/448 |
| 4,978,905 | 12/1990 | Hoff et al. | 323/314 |
| 4,994,688 | 2/1991 | Horiguchi et al. | 307/296.8 |
| 5,029,295 | 7/1991 | Bennett et al. | 323/313 |
| 5,124,632 | 6/1992 | Greaves | 323/316 |
| 5,180,967 | 1/1993 | Yamazaki | 323/315 |
| 5,451,860 | 9/1995 | Khayat | 323/314 |
| 5,483,196 | 1/1996 | Ramet | 323/313 |
| 5,532,579 | 7/1996 | Park | 323/314 |
| 5,570,008 | 10/1996 | Goetz | 323/315 |
| 5,686,824 | 11/1997 | Rapp | 323/313 |
| 5,686,825 | 11/1997 | Suh et al. | 323/316 |
| 5,696,440 | 12/1997 | Harada | 323/315 |

FOREIGN PATENT DOCUMENTS

| | | | |
|---|---|---|---|
| 0 310 743 | 4/1989 | European Pat. Off. | G05F 3/24 |
| 0 356 020 | 2/1990 | European Pat. Off. | G05F 3/24 |
| 0 397 408 | 11/1990 | European Pat. Off. | G05F 3/24 |
| 0 564 225 | 10/1993 | European Pat. Off. | G05F 3/24 |

OTHER PUBLICATIONS

French Search Report from French Patent Application 95 09023, filed Jul. 25, 1995.

*Primary Examiner*—Peter S. Wong
*Assistant Examiner*—Derek J. Jardieu
*Attorney, Agent, or Firm*—Wolf, Greenfield & Sacks, P.C.

[57] ABSTRACT

A reference generator implemented in a MOS technology integrated circuit comprises a current mirror device having three pairs of transistors connected so as to obtain a stable voltage at the mid point of its second arm. This same generator also supplies a stable current.

9 Claims, 5 Drawing Sheets

VOLTAGE AND/OR CURRENT REFERENCE GENERATOR FOR AN INTEGRATED CIRCUIT

BACKGROUND OF THE INVENTION

1. Field of the Invention

The present invention relates to a reference generator for an integrated circuit that is capable of providing a reference voltage and/or current that is stable even when there are variations in the fabrication process and/or the ambient temperature and that is independent of the supply voltage.

2. Discussion of the Related Art

Current or voltage reference generators are commonly used in integrated circuits, notably for the reading or writing of memory cells.

In particular two pairs of MOS transistors are usually used in an arrangement of two current mirrors to provide a current which is independent of the supply voltage. Nevertheless, the reference current obtained is very dependant on any changes in temperature.

SUMMARY OF THE INVENTION

The present invention provides a reference generator that is particularly stable, even when there are variations in the fabrication process, temperature and/or the supply voltage.

One aspect of the invention concerns a reference generator implemented in a MOS technology integrated circuit comprising a current mirror device. This device comprises: a first current source arm having a first diode-connected transistor with a second resistive and native transistor; a second current source arm having a third transistor connected in series with a fourth diode-connected transistor.

The current mirror device may further comprise a third current source arm, connected to a mid point of the second arm. This third arm comprises a fifth transistor that is connected in series with a sixth diode-connected transistor which is connected to said mid point;

the first, third and fifth transistors have the same conductivity type and their gates are connected together;

the second, fourth and sixth transistors have the same conductivity type and the second and fourth transistors have their gates connected together, the fourth transistor having a conduction threshold greater than that of said second and sixth transistors;

so as to supply a stable voltage to said mid point of the second current source arm.

The reference generator according to another aspect of the invention may also supply a stable current. The reference generator then further comprises a fourth current source arm that comprises a seventh transistor, of the same conductivity type as the second transistor and which is little resistive and series-connected with a resistor, this seventh transistor having a threshold voltage less than that of the fourth transistor and receiving the stable voltage on its gate so as to obtain a stable current in that fourth stage.

BRIEF DESCRIPTION OF THE DRAWINGS

Like reference designations denote like elements in the accompanying drawings among which.

DETAILED DESCRIPTION

Figure 1:
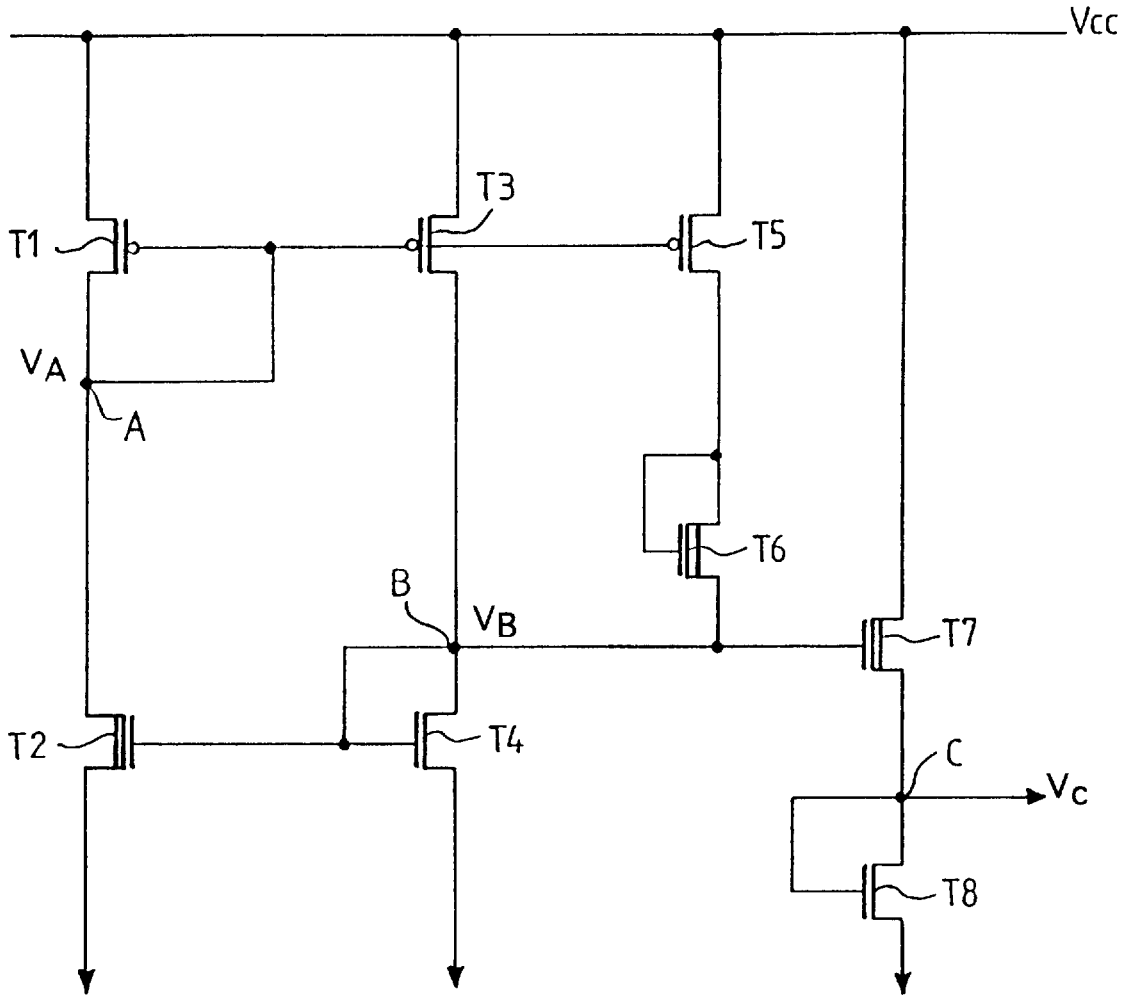
FIG. 1 illustrates a circuit diagram of a reference generator according to the present invention.

FIG. 1 illustrates a circuit diagram of an integrated reference voltage generator circuit, according to one embodiment of the present invention. The transistors illustrated are all fabricated in MOS technology.

The generator comprises a current mirror device with three stages or arms.

A first arm is a current source that comprises a first transistor T1, which is diode-connected (that is to say its gate is connected to its drain) and which is connected in series with a second transistor T2 which is resistive (W/L<<1).

A second arm comprises a third transistor T3 connected in series with a fourth transistor T4 that is diode-connected.

A third section comprises a fifth transistor T5 series-connected with a sixth, diode-connected transistor T6, which is connected to a mid point B of the second arm.

The third and fifth transistors are each in a current mirror configuration with respect to the first transistor.

The second transistor is in a current mirror configuration with respect to the fourth transistor.

Transistor T4 has a threshold voltage Vt, that is greater than those of transistors T2 and T6. In the example, transistor T4 is an enhanced transistor and transistors T2 and T6 are native (that is to say transistors T2 and T6 have a threshold voltage $Vt_{na}$ positive and close to zero volts).

In a current mirror configuration the gate of a first transistor is controlled by a transistor of the same conductivity type, which is diode-connected (i.e. its gate is connected to its drain). In this way, the flow of current in the first transistor can be controlled. The ratio of the currents flowing in the two transistors essentially depends upon their geometry's ratio of width to length, W/L.

In the figures, an embodiment of the reference generator according to the present invention is implemented in a CMOS technology. Therefore, the first, third and fifth transistors are P type conductivity transistors. Their sources are connected to the logic supply voltage Vcc. The second, fourth and sixth transistors are N type conductivity transistors. The sources of the second and fourth transistors are connected to the ground supply. The source of the sixth transistor is connected to node B of the second arm, that is to say to the drains of the third and fourth transistors.

The steady state operation of the reference generator is now described.

Suppose that $Vt_p=Vt_1=Vt_3=Vt_5$ and $Vt_{na}=Vt_2=Vt_6$ and it is noted : $Vt_n=Vt_4$ where $Vt_p$ is the threshold voltage of a P type transistor, which is on the order of one volt, and where $Vt_{na}$ is the threshold voltage of an N type, native transistor, which is on the order of 0.2 volt and where $Vt_n$ is the threshold voltage of an N type, enhanced transistor, which is on the order of 0.8 volts. The above values are only given by way of example, for 1.2 and 1.0 micron technologies and for an ambient temperature (25° C). Other technologies may produce different threshold voltages.

Transistor T2 is resistive (W/L<<1), such that transistor T1 has a voltage on its drain that is close to $Vcc-Vt_p$; which is the voltage $V_A$ at node A. Transistor T3 is resistive such that a voltage $V_B$ on its drain is close to the threshold voltage of transistor T4.

As the voltage $V_A$=Vcc−$Vt_p$ is applied to the gate of transistor T3, the latter is itself biased such that it is at the limit of conduction (the gate source voltage is on the order of its threshold voltage). Therefore, this accentuates its resistive characteristics so as to maintain $V_B$ equal to $Vt_n$=$Vt_4$.

Since transistor T2 is connected as a current mirror with respect to transistor T4, the voltage VB is applied to the gate of transistor T2. But it has been seen that the threshold voltage of transistor T2 is lower than the threshold voltage of transistor T4. In this example $Vt_n$=0.8 v and $Vt_{na}$=0.2 v.

Therefore, transistor T2 is highly conductive. Since it has been chosen to be sufficiently resistive so that $V_A$=Vcc−$Vt_p$ on its drain, transistor T2 also has a drain-source voltage $V_{DS}$=Vcc−$Vt_p$ much greater than its gate-source voltage $V_{GS}$=$Vt_4$. Therefore, transistor T2 is saturated, which ensures a relatively constant current in the arm comprising transistors T1 and T2, and thus in the arm comprising transistors T3 and T4 too, even if the supply voltage varies.

Transistor T5 is biased in the same manner as transistor T3, that is to say at its limit of conduction.

Transistor T6 is diode-connected. Since its threshold voltage is low, i.e. close to zero, the arm (T5,T6) which is in parallel with transistor T3, tends to reduce the equivalent resistance which charges transistor T4 and this therefore tends to slightly increase the level of the voltage $V_B$.

What happens then when there are variations with the ambient temperature, the fabrication process or the supply voltage?

If the temperature increases, it is known that the threshold voltages will reduce by approximately 2 millivolts per degree Celcius. The voltage $V_A$ will therefore increase, which will make transistor T3 more resistive, and the same for transistor T5. However, their threshold voltages also reduce. Since the threshold voltage of transistor T4 reduces, the level of the voltage $V_B$ therefore has a tendency to reduce. But the threshold voltage of transistor T6 also reduces, (the transistor is almost equivalent to a short circuit): the equivalent resistance of T3//T5+T6 therefore reduces, which tends to pull the level of the voltage $V_B$ higher and therefore to stabilise it.

In practice, it has been verified that the variation with the temperature of the level of the voltage $V_B$ follows at worst, the threshold voltage of a transistor. One can then obtain a variation of 13% between 25° C. and 90° C., which can be considered as very satisfactory.

With each fabrication process corresponds a range of possible threshold values for the transistors thereby obtained. But two transistors that are in close proximity will in practice have the same threshold voltage values.

In one example, one can obtain P-type transistors with a threshold voltage $Vt_p$ in a range of [0.9 v−1.3 v] and N-type transistors with a threshold voltage $Vt_n$ in a range of [0.7 v−1.0 v].

If all the transistors have their threshold voltages at the maximum values given by the fabrication process, the voltage $V_A$ has a tendency to reduce, which will cause the current in transistor T3 to increase. But at the same time the threshold voltage of transistor T3 is also increased, which tends to cause the current in transistor T3 to reduce. At the same time, the threshold voltage of transistor T4 increases and the level of the voltage $V_B$ has a tendency to increase. Since the threshold voltage of transistor T6 also increases, the equivalent resistance of T3//T5+T6 increases, which tends to stabilise the level of the voltage $V_B$. In practice, one can verify that the voltage $V_B$ follows, at worst, the variation of a threshold voltage of an N type transistor (T4).

The corresponding opposite reasoning can be applied in the case where the threshold voltages are at the minimum values.

It is also possible to have crossed variations, for example maximum $Vt_n$ and minimum $Vt_p$. In this case there is auto-compensation in transistor T3, as has been described above. The level of the voltage $V_B$ therefore has a tendency to increase, like the threshold voltage of transistor T4. But since transistor T6 also has a threshold voltage which is much greater, the equivalent resistance of T3//T5+T6 reduces, which prevents the level of the voltage $V_B$ from increasing.

The corresponding opposite reasoning applies for minimum $Vt_n$ and maximum $Vt_p$.

This stability of the voltage $V_B$ with variations due to the fabrication process allows to have a reference generator that is perfectly reproducible from one integrated circuit to another. Furthermore, there is no regulation to carry out and there are less rejects due to the fabrication process variations.

If it is the supply voltage which varies, it is the input resistance Ron of the transistors which varies. Notably, if Vcc increases, the input resistance of transistor T1 increases and the voltage $V_A$ reduces. Since the voltage $V_A$ is applied to the gate of transistor T3, the voltage $V_B$ will also tends to increase, but at the same time, the input resistance of transistor T3 increases and therefore the effects compensate each other. The structure with the arms sections according to the present invention allows to obtain in practice a voltage level $V_B$ which varies in the worst case with the threshold voltage of a transistor.

In a preferred embodiment of the present invention, a fourth arm is introduced which is connected to node B so as to compensate the variation of the voltage $V_B$ with the threshold voltage $Vt_n$.

Theory and experience shows indeed that the different threshold voltages of two transistors of the same conductivity type being subjected to different ionic implantations vary with temperature and the fabrication process, but their difference does not vary neither with temperature or with the fabrication process.

In the present invention, it is proposed to use this characteristic so as to obtain a reference voltage $V_C$ which does not vary with temperature or with the fabrication process.

The fourth arm then comprises an N type transistor T7 connected in series with an enhanced N type transistor T8 ("normally off"). Transistor T7 has a threshold voltage which is less than that of transistor T8. In the example, transistor T7 is native. Transistor T7 receives the voltage $V_B$ on its gate. Transistor T8 is diode-connected (its gate is connected to its drain).

A reference voltage VC is thus obtained at a mid-point C between the two transistors T7 and T8 and equals:

$$V_C=V_B-Vt_{na}=Vt_n-Vt_{na}.$$

The level of this voltage is lower than that of $V_B$, but it is completely auto-compensated with respect to temperature variations. In practice it can be shown that it is also auto-compensated with respect to variations in the fabrication process.

Furthermore, if transistor T8 is chosen such that it is sufficiently resistive and transistor T7 has a low input resistance Ron (strong conductance), a good compensation for variations in the supply voltage is also obtained.

The levels of the reference voltages $V_B$ or $V_C$ obtained are relatively small (for example, in the order of 1 volt for $V_B$ and 0.8 volts for $V_C$), but they are sufficient to bias the gates of memory cells. One can obtain voltage levels a little higher (1.2–1.6 volts) by increasing the ratio W/L of one or another of the transistors T3, T5. A small loss of stability with respect to the supply voltage will result, but without loss in stability with respect to the fabrication process or temperature.

Figure 2:
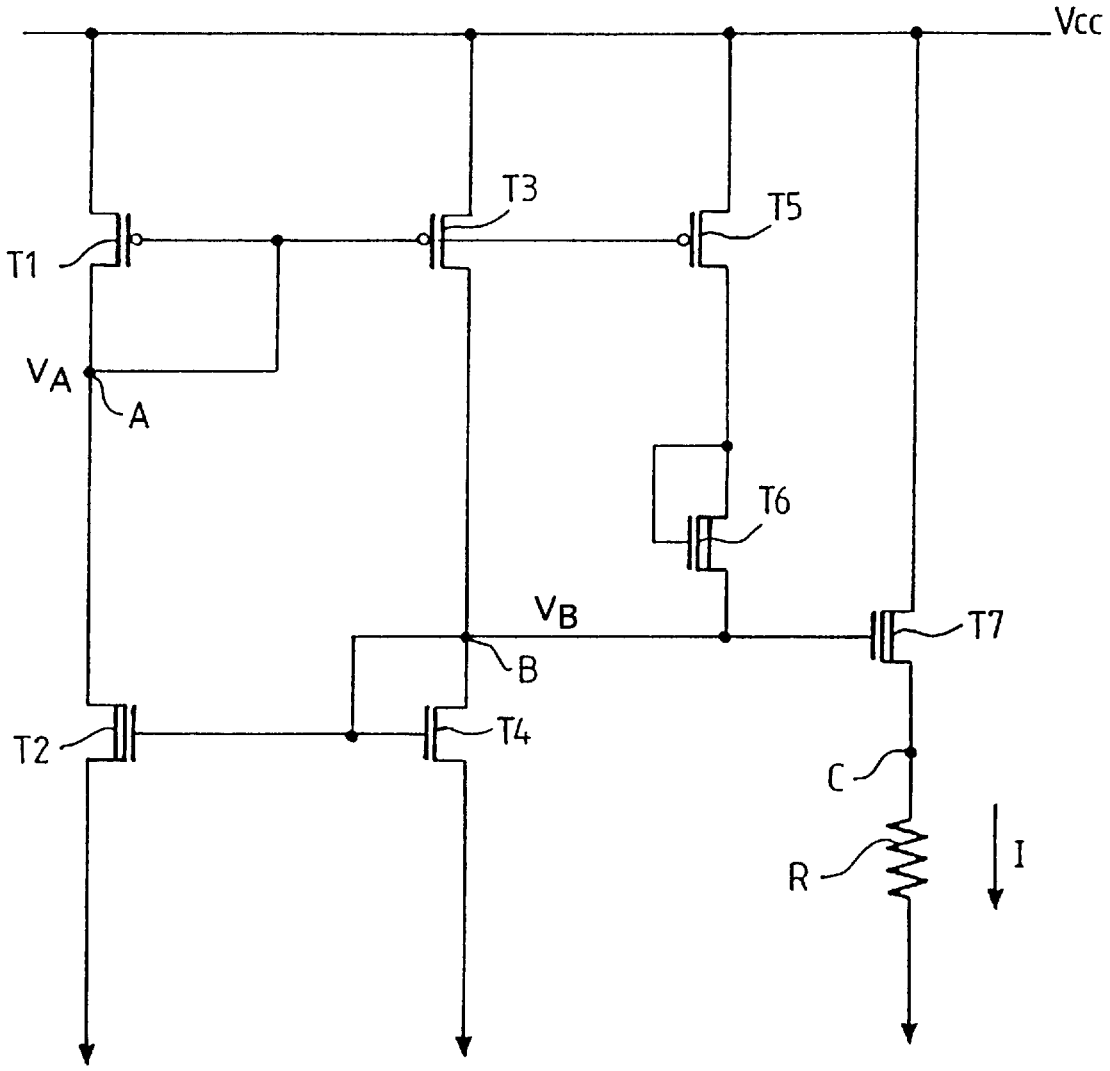
FIG. 2 illustrates a circuit diagram of a reference generator according to the present invention that provides a stable current.

A reference generator according to the present invention also may supply a reference current. A reference current generator is represented in FIG. 2. The same elements illustrated in FIG. 1 are used, except that transistor T8 is replaced by a real resistor (passive), made from a resistive material chosen to be very stable with variations in temperature and the process technology used. An example of such a resistor can be achieved by using an N type diffusion.

The resulting current I does not vary either with the supply voltage Vcc, the temperature or the fabrication process. The resulting current I is proportional to the ratio $V_C/R$: where $V_C=Vt_n-Vt_{na}$ and R is the value of the resistor.

The only variation in the current is therefore due to variations of the value of the resistor R, which are caused by process variations.

Figure 3:
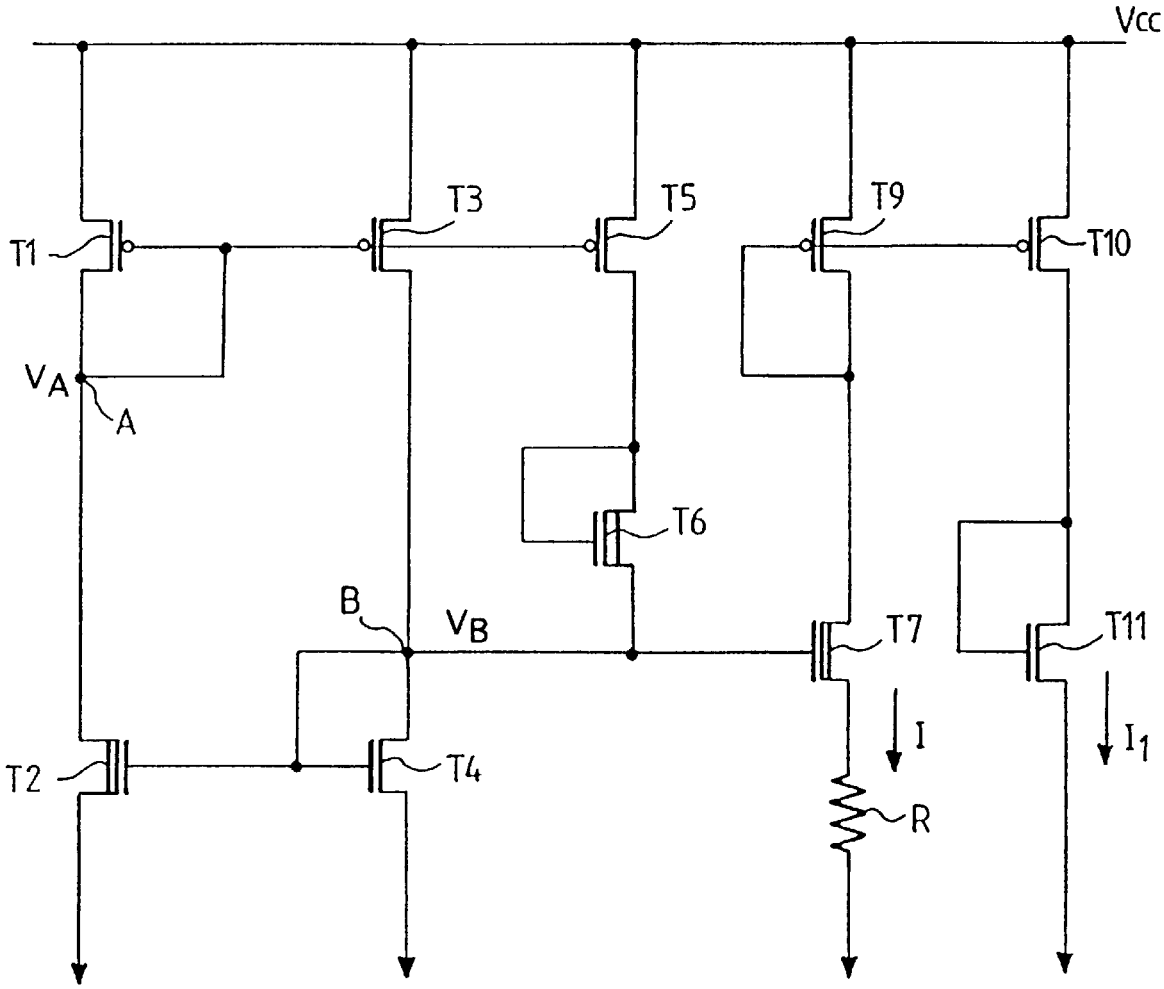
FIG. 3 illustrates another embodiment of the generator illustrated in FIG. 2 and FIGS. 4 and 5 are detailed circuit diagrams of FIGS. 1 and 3 with corresponding bias circuits.

Advantageously, in order to obtain several reference currents suitable for supplying several circuits, successive current mirror stages may be simply used. Such a refinement is illustrated in FIG. 3.

Thus, a transistor T9 is placed in series between the supply voltage Vcc and transistor T7. This transistor is diode-connected and is a P type transistor in the example.

A fifth arm to deliver a reference current I1 comprises a transistor T10 series-connected with a transistor T11. Transistor T10 has the same conductivity type as transistor T9. Transistor T11 is diode-connected and has the same conductivity type as transistor T7, but with a higher threshold voltage ($Vt_n$).

Figure 4:
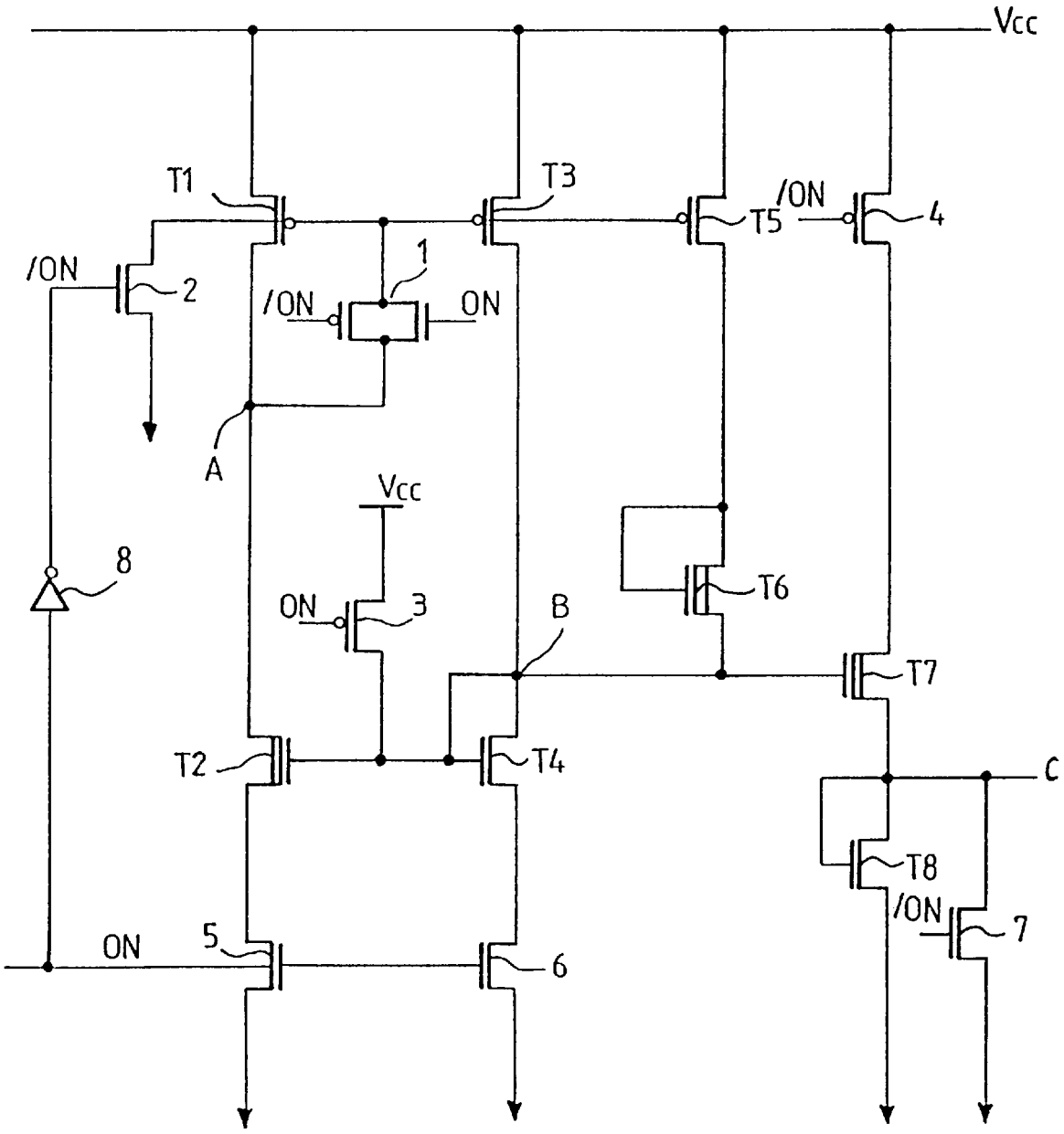
Figure 5:
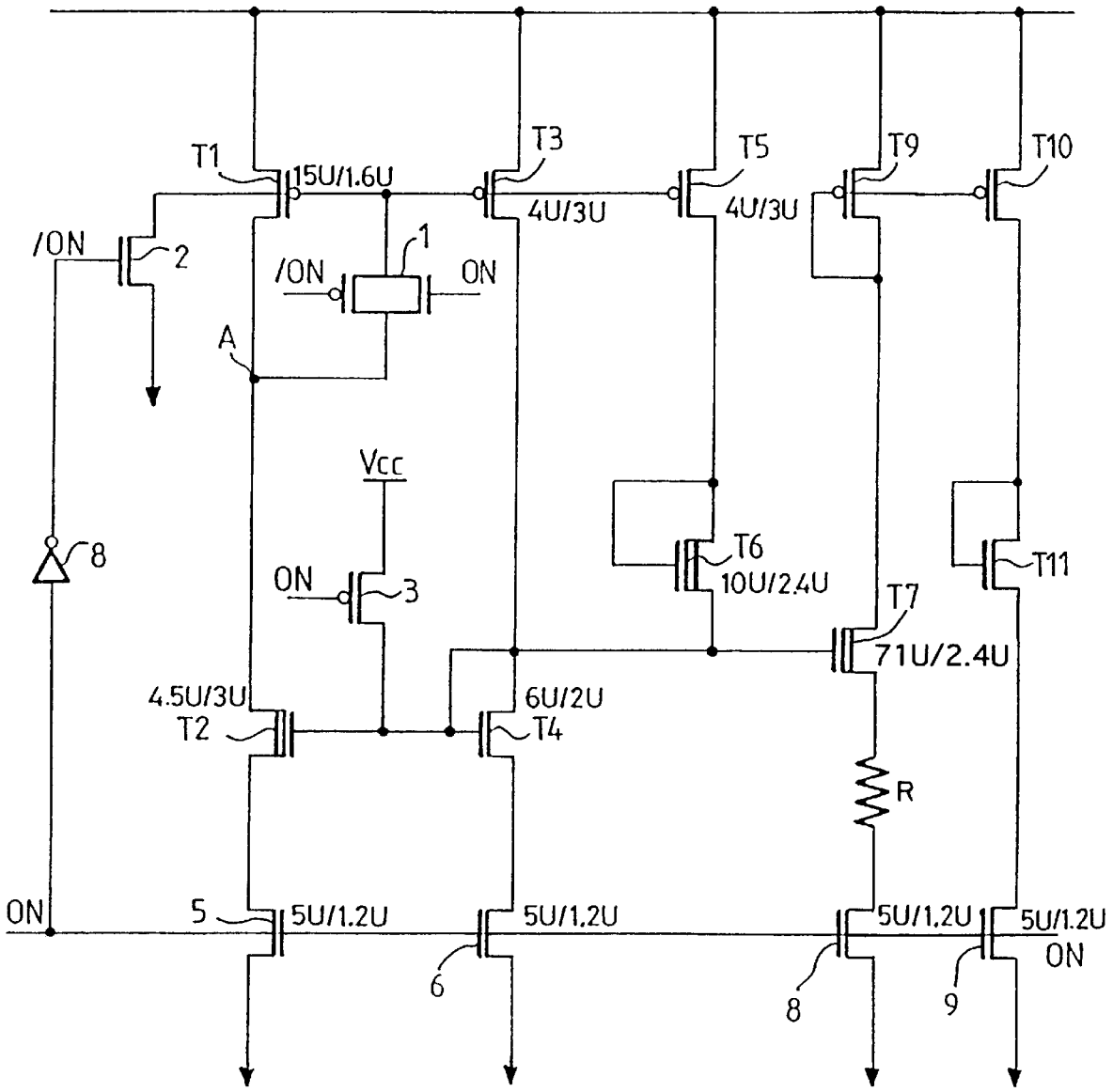

It is possible to use several successive arms of the same type as the fifth arm so as to obtain other reference currents. FIGS. 4 and 5 illustrate detailed circuit diagrams of the circuits more generally shown in FIGS. 1 and 3. These circuit diagrams illustrate an example of a bias circuit of a reference generator according to the present invention.

Thus, in FIG. 4, a pair 1 of transistors of opposite conductivity types is placed in parallel, between the gate and the drain of transistor T1. When the generator is active (ON=1), this pair 1 pulls the voltage $V_A$ towards a positive potential. This phenomenon is accentuated by a transistor 2, here illustrated as an N type transistor, which isolates at the same time the gate voltage of transistor T1 from the ground potential.

Another transistor 3, illustrated here as a P type, isolates the gate voltage of transistors T2 and T4 from the supply voltage Vcc so as to stop the gate voltage $V_B$ from increasing too much.

A transistor 4, illustrated here as a P type transistor, allows the supply voltage to be applied to the drain of T7. This transistor 4 allows the current consumption to be reduced when the generator is not active (ON=0).

Transistors 5 and 6, illustrated here as N type transistors, each respectively in series with transistors T2 and T4, pull the sources of these two transistors to ground potential.

Finally, a transistor 7 is connected in parallel with transistor T9 so as to pull node C to ground potential when the generator is not active.

In the example, the activation signal ON of the generator, which is supplied by a control circuit not shown, controls the gates of transistors 5 and 6 and the gate of the N type transistor of the pair 1. An inverter 8 allows one to obtain the corresponding inverse control signal/ON which is used to control the transistors 2, 4, 7 and the P type transistor of the pair 1.

The bias circuit enables transistors T1 and T4 to be biased at the limit of conduction and it reduces the current consumption when the generator is off.

FIG. 5 represents a bias circuit for the reference generator used to supply a stable current. This generator comprises the same elements 1, 2, 5 and 6 as shown in FIG. 4. It further comprises two transistors 8 and 9, of the N type in the example, respectively connected in series with the current generation arms to pull them to ground potential. This generator does not include the elements 4 and 7 shown in FIG. 4.

The figures represent embodiments of a reference generator realised in a CMOS technology. But the present invention is not particularly limited to this technology. The present invention can more generally be realised in a MOS technology, with transistors connected as current mirrors of the same conductivity type and a fifth arm of two transistors (T7, T8) of the same type so as to obtain temperature compensation. In embodiments of the reference generator according to the present invention as shown in FIGS. 1 and 2:

$$Vcc>V_c$$

i.e. $Vcc>Vt_n-Vt_{na}$ whereas for FIG. 3:

$$Vcc>V_c$$

i.e. $Vcc>Vt_p+Vt_n-Vt_{na}$.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. A reference generator implemented in a MOS technology integrated circuit with a current mirror device comprising:

a first current source arm connected at one end to a supply voltage line, and having a first transistor connected as a diode and connected in series with a second transistor that is native and resistive;

a second current source arm connected at one end to the supply voltage line, and having a third transistor connected in series with a fourth transistor that is connected as a diode, the connection between the third and fourth transistor defining a mid-point;

wherein said device comprises a third current source arm connected at one end to the supply voltage line, the third current source arm including a fifth transistor that is connected in series with a sixth transistor which is connected as a diodes and the third current source arm connected at another end to said mid-point;

the first, third and fifth transistors having the same conductivity type and their gates being connected together, the second, fourth and sixth transistors having the same conductivity type and the second and fourth transistors having their gates connected together, the fourth transistor having a conduction threshold greater than that of said second and sixth transistors so as to supply a stable voltage to said mid-point of the second current source arm.

2. A reference generator according to claim 1, further comprising:

an output stage with a seventh and an eighth transistor being series-connected and of the same conductivity type as the second transistor, the seventh transistor being little resistive and receiving on its gate said stable voltage, the eighth transistor being diode-connected and very resistive, and having a conduction threshold greater than that of the seventh transistor, so as to supply an output voltage to an output node between said seventh and eight transistors.

3. A reference generator according to claim 2, wherein the seventh transistor has a low input resistance.

4. A reference generator according to claim 1, further comprising: a fourth arm with a seventh transistor of the same conductivity type as the second transistor, little resistive and series-connected with a resistor, the seventh transistor having a threshold voltage less than that of the fourth transistor and receiving the stable voltage on its gate, so as to obtain a stable current flowing through the resistor.

5. A current generator according to claim 4, further comprising: at least a fifth arm that is connected as a current mirror with respect to the fourth arm, the fourth arm further comprising a ninth transistor of the same conductivity type as the first transistor and diode-connected.

6. A reference generator according to any one of the preceding claims, implemented in a CMOS technology, the first transistor being of P type conductivity and the second transistor being of N type conductivity.

7. A method for generating a stable reference, comprising:

sensing a current flowing in a first branch of a circuit;

inducing a current in a second branch of the circuit equal to the current flowing in the first branch of the circuit;

sensing a current flowing through an output device in the second branch of the circuit;

stabilizing the current flowing in the first branch of the circuit in response to the current flowing in the second branch of the circuit using a third branch of the circuit connected to a node of the second branch of the circuit;

biasing the output device to a stable bias voltage in response to the current flowing in the first branch of the circuit; and buffering the stable bias voltage to form the stable reference.

8. The method of claim 7, wherein the step of buffering further comprises the step of:

applying the stable bias voltage to a diode output load, to form a stable reference voltage.

9. The method of claim 7, wherein the step of buffering further comprises the step of:

applying the stable bias voltage to a resistive output load, to form a stable reference current.

* * * * *